US011585127B2

(12) United States Patent
Rosales

(10) Patent No.: US 11,585,127 B2
(45) Date of Patent: Feb. 21, 2023

(54) MOTOR VEHICLE LOCK

(71) Applicant: Brose Schließsysteme GmbH & Co. Kommanditgesellschaft, Wuppertal, Wuppertal (DE)

(72) Inventor: David Rosales, Rochester Hills, MI (US)

(73) Assignee: Brose Schließsysteme GmbH & Co. Kommanditgesellschaft, Wuppertal

( * ) Notice: Subject to any disclaimer, the term of this patent is extended or adjusted under 35 U.S.C. 154(b) by 675 days.

(21) Appl. No.: 16/458,445

(22) Filed: Jul. 1, 2019

(65) Prior Publication Data

US 2021/0002927 A1 Jan. 7, 2021

(51) Int. Cl.
*E05B 81/20* (2014.01)
*E05B 85/24* (2014.01)

(52) U.S. Cl.
CPC ..... *E05B 81/20* (2013.01); *E05B 85/24* (2013.01)

(58) Field of Classification Search
CPC ..... E05B 81/00; E05B 81/04; E05B 81/14; E05B 81/16; E05B 81/20; E05B 85/24; E05B 17/0029; Y10S 292/23; Y10T 292/1047; Y10T 292/1082
See application file for complete search history.

(56) References Cited

U.S. PATENT DOCUMENTS 10,480,224 B2 * 11/2019 Wilkes ..... E05C 3/12
2019/0145135 A1 * 5/2019 Lebsak ..... E05B 81/20 292/229

FOREIGN PATENT DOCUMENTS

DE 202014103819 U1 11/2015
DE 102016218299 A1 3/2017
DE 102018117107 A1 1/2019

* cited by examiner

*Primary Examiner* — Mark A Williams
(74) *Attorney, Agent, or Firm* — Dickinson Wright PLLC

(57) ABSTRACT

A motor vehicle lock including configured to pivot along a cinching path, including a first section and a second section, between an open position, a primary closed position, and a secondary closed position. A pawl moveable between a released state, disengaged from the catch, and an engaged state, engaged with the catch. A first cinching mechanism including a first engagement lever configured to engage and pivot the catch along the first section. A second cinching mechanism including a second engagement lever configured to engage and pivot the catch along at least a portion of the second section.

18 Claims, 4 Drawing Sheets

MOTOR VEHICLE LOCK

TECHNICAL FIELD

The present disclosure relates to a motor vehicle lock.

BACKGROUND

Motor vehicles may include a motor vehicle lock for any kind of closure element of a motor vehicle, such as a liftgate, a trunk lid, rear hatch, rear door, front hood, side door, or the like. The closure elements may be pivotable or slidable. Certain closures may close and open automatically, e.g. without the assistance of an operator. Vehicles generally include a seal or other type of weather proofing barrier positioned between the closure and the vehicle body to mitigate external elements such as moisture, precipitation, dirt, debris, and noise from entering the interior of the vehicle. The force applied to the closure, by a latch for example, must be sufficient to overcome pressure associated with the closure and the seal to provide a cinching function. Also, the vehicle may be equipped with a device or mechanism that may automatically release the latch, so the closure may move to an open position.

Often such vehicles include an additional drivetrain that may increase the size of the motor vehicle lock arrangement.

SUMMARY

One or more objects of the present disclosure may be to provide a motor vehicle lock with a cinching function, which allows to enlarge the cinching path of the catch without unduly increasing the constructional size of the cinching mechanism.

The present disclosure may provide a cinching arrangement not only with one cinching mechanism, but to provide the cinching arrangement with at least two cinching mechanisms, which act on the catch for producing the cinching path in sequential manner. This approach makes it possible to enlarge the cinching path just by combining two cinching mechanisms, which are each driving the catch only in respective sections of the cinching path. This generally allows for a compact constructional size even with extensive enlargement of the cinching path. In addition, it is possible to adapt the cinching mechanisms to the cinching torque needed for the respective section of the cinching path of the catch.

In one or more embodiments, the cinching arrangement may include a first cinching mechanism, which, during the cinching sequence, enters into engagement with the catch for driving the catch along a first section of the cinching path. It is further proposed, that the cinching arrangement may include a second cinching mechanism, which enters into engagement with the catch for driving the catch along a second section of the cinching path. Here it is to be noted, that the first section of the cinching path and the second section of the cinching path are at least partly different from each other. Further it is to be noted that, during the cinching sequence, the first section of the cinching path is followed by the second section of the cinching path. The sequence of the first section of the cinching path and the second section of the cinching path is to be understood in a broad sense, such that a certain overlap between both sections of the cinching path is possible.

The first cinching mechanism and the second cinching mechanism may be designed, at least partly, separately from each other. This includes an arrangement in which each cinching mechanism includes at least one component that is commonly used by both cinching mechanisms.

An enlargement of the cinching path from the open position to the main closed position may be realized by one or more embodiments provided herein.

According to one or more embodiments, the cinching arrangement may include a cinching lever, that may be driveable from a base position into a cinching position via the first cinching mechanism with respect to the second cinching mechanism, thereby driving the catch along the cinching path. The cinching lever may be coupled to a motorized cinching drive, in order to realize a motorized cinching sequence with low constructional effort.

In order to be able to design the two cinching mechanisms independently from each other at least to a certain degree, each cinching mechanism may include a separate engagement lever.

According to one or more embodiments, the first cinching mechanism may be provided with a coupling mechanism so that the drive train of the first cinching mechanism is disconnected from the catch along the second section of the cinching path.

The second cinching mechanism may provide a knee lever mechanism, that may be of a simple constructional mechanism for producing high torques and at the same time makes it easy for the second cinching mechanism to disengage from the catch, after the cinching sequence has been completed.

As one example, a gear ration of the cinching mechanisms may be adjusted to the cinching torque needed in a respective cinching path. This may lead to a robust cinching sequence with a very compact constructional design.

According to one or more embodiments, the motor vehicle lock may be provided with or coupled to a motorized cinching drive. The motorized cinching drive may be coupled to the motor vehicle lock in order to provide a motorized cinching sequence. All explanations given with respect to the first teaching are fully applicable to this second teaching.

The motorized cinching drive may be arranged separately from the motor vehicle lock, that may allow for a modular arrangement of the motor vehicle lock arrangement. However, it may be pointed out, that the motorized cinching drive may be integrated into the motor vehicle lock, that may provide a very compact arrangement.

BRIEF DESCRIPTION OF THE DRAWINGS

In the following, an embodiment of the invention is explained with respect to the drawings. In the drawings show FIG. 1 a motor vehicle with a proposed motor vehicle lock, FIG. 2 the motor vehicle lock according to FIG. 1 during the cinching sequence with the catch in its open position, FIG. 3 the motor vehicle lock according to FIG. 2 during the cinching sequence with the catch in its preliminary closed position and FIG. 4 the motor vehicle lock according to FIG. 2 during the cinching sequence with the catch in its main closed position.

DETAILED DESCRIPTION

Figure 1:
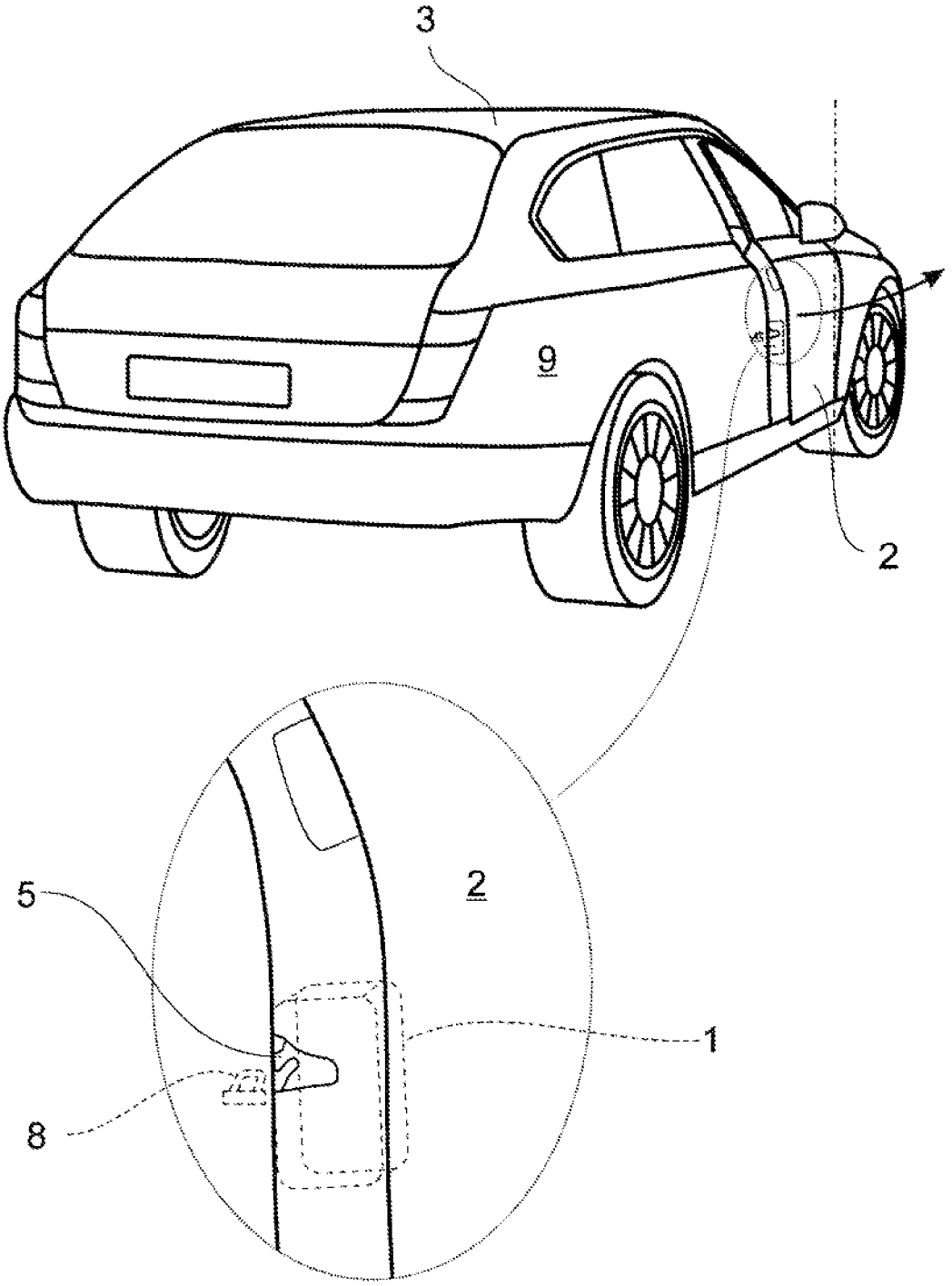

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

One or more challenges presented by a convention motor vehicle lock may be the relatively large cinching path required to complete the cinching function. The large cinching path may increase the size and weight of the latch.

The present disclosure may provide a motor vehicle lock that attempts to provide one or more solutions to this challenge and others.

The motor vehicle lock in question may be assigned to any kind of closure element of a motor vehicle. Such a closure element of a motor vehicle may be a liftgate, a trunk lid, a back door, a front hood, a side door or the like. All those closure elements may be designed as pivotable or slidable closure elements.

The motor vehicle lock in question may include various motorized functions in order to increase the user-friendliness of the motor vehicle all together. One function is the so-called "cinching function", which provides a motorized closing movement of the assigned closure element just before reaching its fully closed position. This increases the user-friendliness, as this last section of the closing movement is to be performed against those forces, which are being generated by compression of the seals of the closure element in this last section of the closing movement.

The motor vehicle lock (DE 20 2014 103 819 U1), which is the starting point of the invention, may include a detent mechanism with a catch and a pawl arrangement, which interact with each other in order to hold the closure element in its respective closed position. For this, the catch may be pivoted between an open position, a primary closed position and a secondary closed position, which is located between the open position and the primary closed position. For the cinching function, a cinching arrangement is provided, which, in a cinching sequence, enters into engagement with the catch and drives the catch along a cinching path in its closing direction into an overtravel position beyond the primary closed position. The cinching arrangement may include a cinching mechanism in the form of a knee lever mechanism, which is driven by a cinching drive located separately from the motor vehicle lock. The knee lever mechanism allows the introduction of a high torque into the catch for cinching with a relatively low driving torque produced by the cinching drive.

The proposed motor vehicle lock 1 may be assigned to any kind of closure element of a motor vehicle. Insofar, reference is made to the introductory part of the specification. Here, the holding element 2 is a side door of the motor vehicle 3. All explanations given with respect to this closure element 2 are fully applicable to all other closure elements.

For holding the closure element 2 in its respective closed position, the motor vehicle lock 1 may include a detent mechanism 4 with a catch 5 and a pawl arrangement 6. In the illustrated embodiment, the pawl arrangement 6 may include only one pawl 7, which directly interacts with the catch 5. Depending on the field of application, the pawl arrangement 6 may include more than one pawl, such as two pawls, that are in blocking engagement with each other.

The catch 5 may be pivoted around its catch axis 5*a* between an open position (FIG. 2) and a primary closed position (FIG. 4) and a secondary closed position (FIG. 3), which secondary closed position is situated between the open position and the primary closed position. The pawl arrangement 6, here the pawl 7, in an engaged state, blocks the catch 5 in the respective closed position and may be raised into a release state to release the catch 5. In the respective closed position, the catch 5 is in holding engagement with a lock striker 8, which leads to the closure element 2 being held in its respective closed position.

In the drawings, the motor vehicle lock 1 is arranged at the closure element 2, while the lock striker 8 is arranged at the motor vehicle body 9. This may be provided in a vice versa manner.

Figure 2:
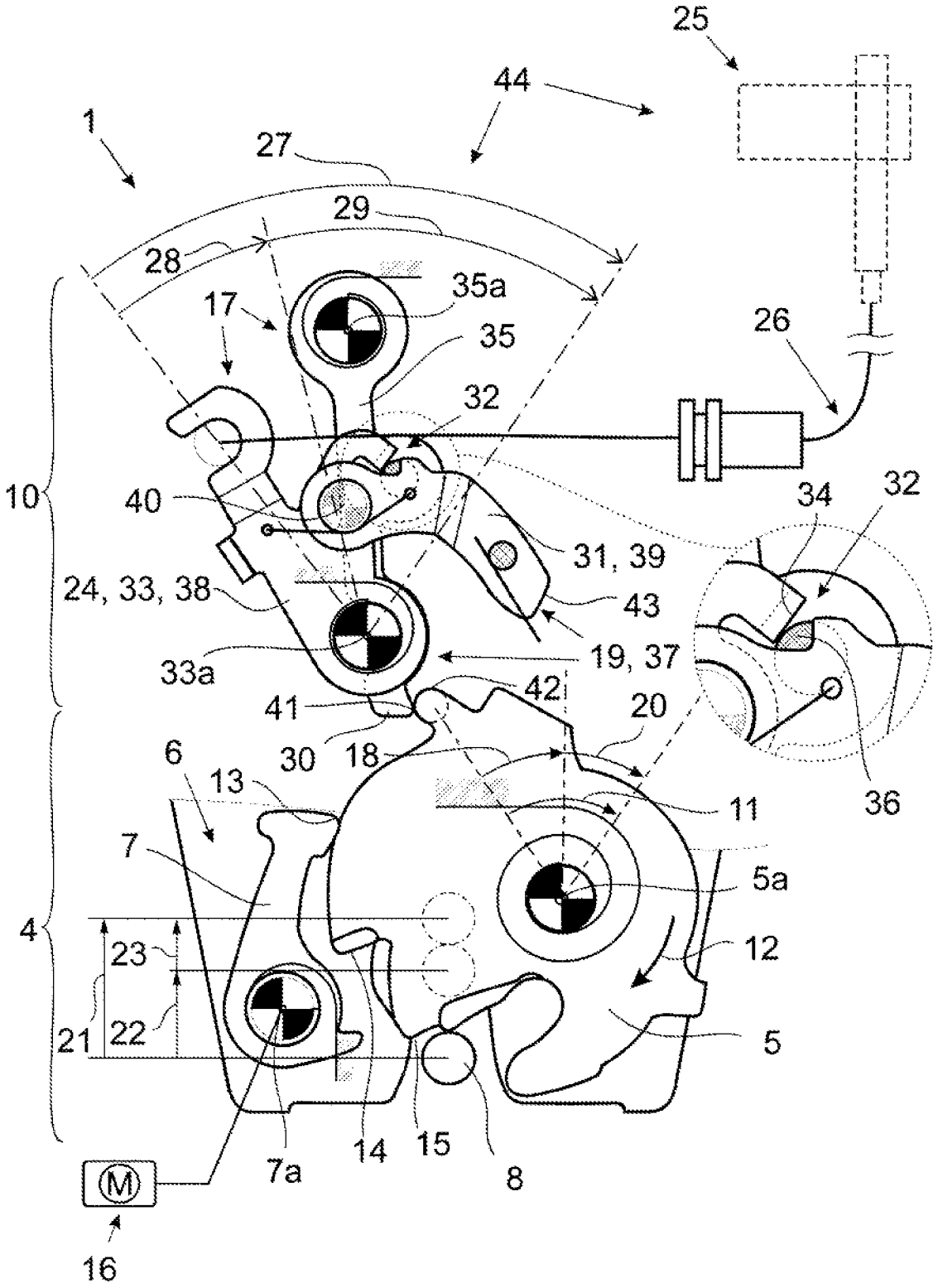
Figure 3:
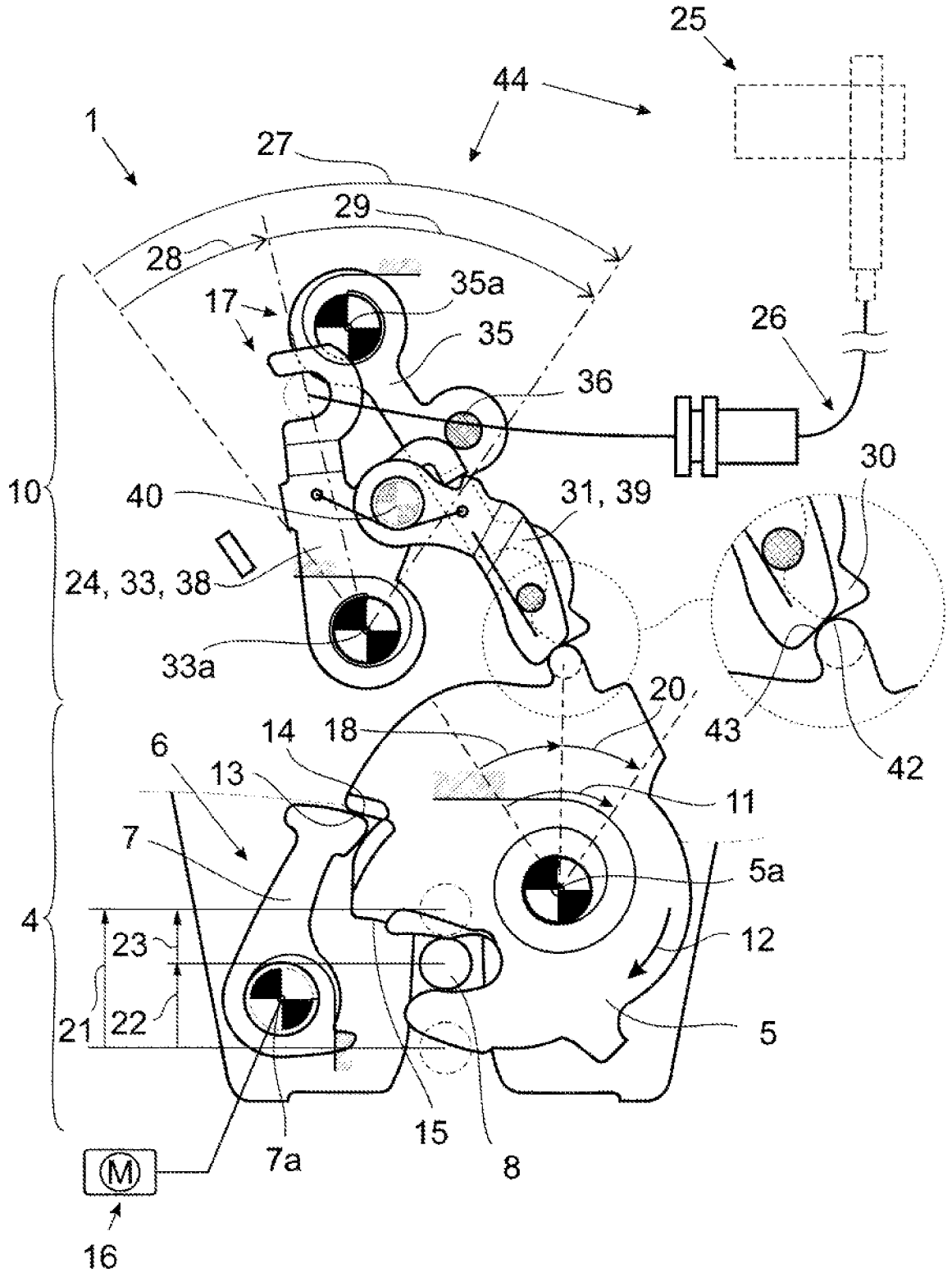
Figure 4:
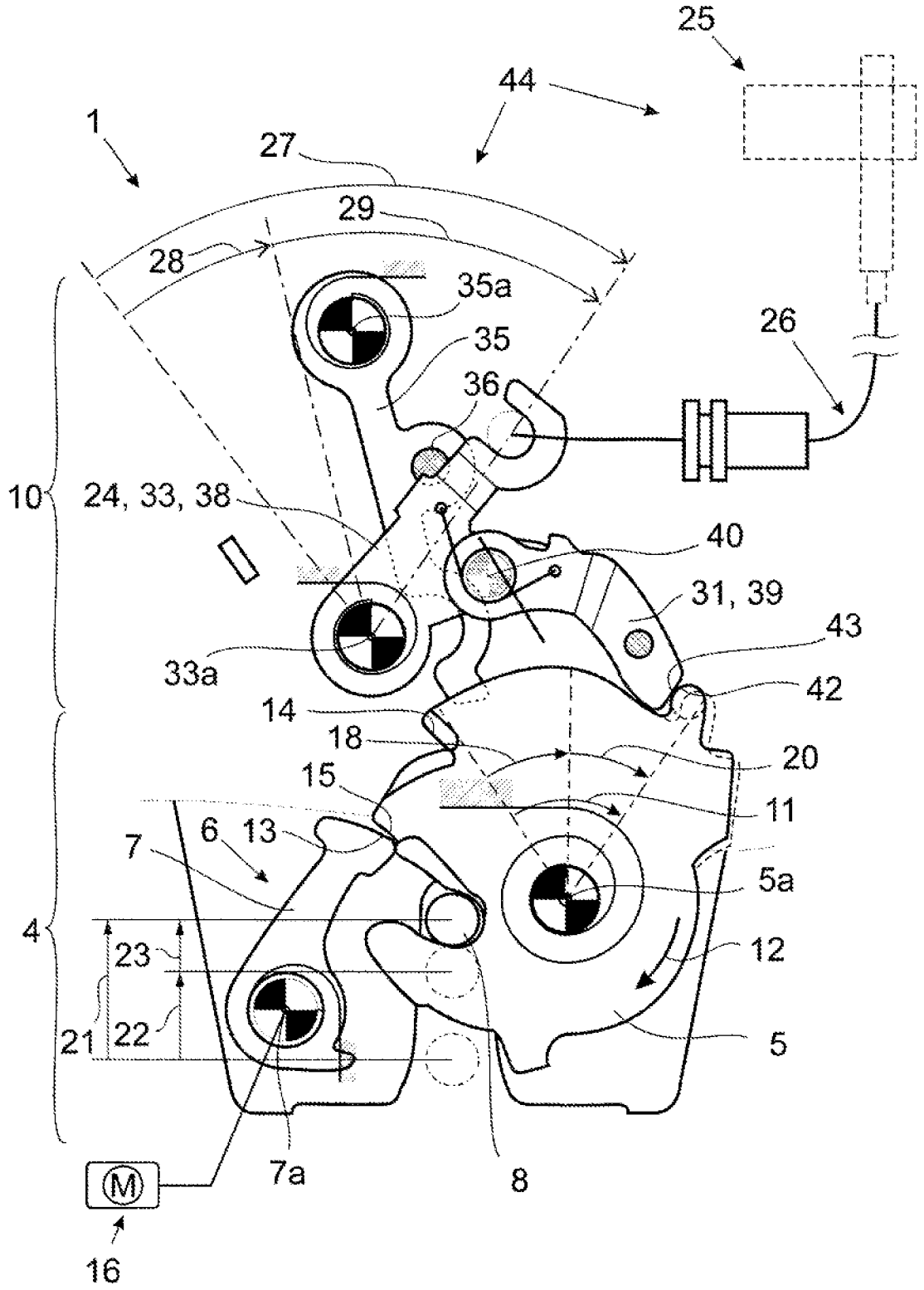

The proposed motor vehicle lock 1 also may include a cinching arrangement 10, wherein in a cinching sequence, the cinching arrangement 10 enters into engagement with the catch 5 and drives the catch 5 along a cinching path 11 in its closing direction 12 into its primary closed position, and possibly into an overtravel position beyond the primary closed position. The overtravel position is only indicated with dotted lines in FIG. 4. The cinching sequence is represented by the sequence of FIG. 2, FIG. 3 and FIG. 4. This sequence also shows, that the pawl 7 may include a blocking surface 13, which is in blocking engagement with a preliminary detent 14 with the catch 5 in its preliminary closed position and which is in blocking engagement with a main detent 15 with the catch 5 in its main closed position.

For opening of the motor vehicle lock 1, the pawl 7 may be coupled to a motorized opening drive 16, as indicated in the drawings. The opening drive 16 may cause a release movement of the pawl 7, such that the catch 5 may pivot into its open position. For the release movement, the pawl 7 is pivot-able around the pawl axis 7*a*. The motorized opening of the motor vehicle lock 1 is just mentioned as an example. A manual opening of the motor vehicle lock 1 by manually releasing the pawl 7 may equally be realized.

It is essential for the invention, that the cinching arrangement 10 may include a first cinching mechanism 17, which, during the cinching sequence, enters into engagement with the catch 5 for driving the catch 5 along a first section 18 of the cinching path 11. It is further essential for the invention, that the cinching arrangement 10 may include a second cinching mechanism 19, which enters into engagement with the catch 5 for driving the catch 5 along a second section 20 of the cinching path 11.

The first section 18 of the cinching path 11 and the second section 20 of the cinching path 11 are indicated in FIGS. 2 to 4. This representation also shows, that the cinching sequence corresponds to a movement of the lock striker 8 in relation to the motor vehicle lock 1, by the lock striker 8 following a striker path 21 accordingly, which in consequence may include a first section 22 and a second section 23, corresponding to the respective sections 18, 20 of the cinching path 11.

The striker path 21 of the lock striker 8 may extend over a certain cinching distance, such as between 12 mm and 20 mm or between 14 mm and 18 mm. As another example, the cinching distance is around 16 mm.

It may well be provided, that the cinching path 11 originates at the preliminary closed position of the catch 5 or that the cinching path 11 originates at an upstream closed position of the catch 5, which is between the open position and the preliminary closed position. In one or more embodiments, the cinching path 11 originates at the open position of the catch 5, such that the cinching path extends from the open position of the catch 5 to the closed position of the catch 5, possibly into an overtravel position beyond the primary closed position.

The sequence of FIG. 2 and FIG. 3 shows, that the first section 18 of the cinching path 11 extends from the open position to the preliminary closed position, wherein the second section 20 of the cinching path 11 extends from the preliminary closed position to the primary closed position, or to an overtravel position beyond the primary closed position. Here, it is also to be realized, that the cinching path 11 may originate not from the open position, but from the above noted upstream closed position.

As the transfer between the first section 18 of the cinching path 11 and the second section 20 of the cinching path 11 has to be realized mechanically, it may result, that the two sections 18, 20 of the cinching path 11 are partly overlapping each other. As an alternative, it may be that the two sections 18, 20 of the cinching path 11 are exactly adjacent to each other.

As shown in the drawings, the first cinching mechanism 17 and the second cinching mechanism 19 may each be formed as lever gears. The cinching arrangement 10 may include a cinching lever 24 that may be driveable from a base position (FIG. 2) into a cinching position (FIG. 4), thereby driving the catch 5 via the first cinching mechanism 17 along the first section 18 of the cinching path 11 and via the second cinching mechanism 19 along the second section 20 of the cinching path 11. As shown in FIGS. 2 to 4, for producing a motorized cinching sequence, the cinching lever 24 is coupled or may be coupled to a motorized cinching drive 25. In the drawings, the motorized cinching drive 25 is not part of the motor vehicle lock 1. It is coupled to the motor vehicle lock 1, here to the cinching lever 24, via a Bowden cable 26. However, the cinching drive 25 may also be integrated into the motor vehicle lock 1, in order to provide a compact arrangement.

It may also be derived from the drawings, that the cinching lever 24, during the cinching sequence, follows a cinching lever path 27 with a first section 28 and a second section 29, which two sections 28, 29 of the cinching lever path 27 correspond to the respective sections 18, 20; 22, 23 of the catch 5 and the lock striker 8.

It becomes apparent from FIGS. 2 to 4, that the two cinching mechanisms 17, 19 engage the catch 5 separately from each other. Accordingly, the first cinching mechanism 17 may include a first engagement lever 30 for the engagement with the catch 5, in order to drive the catch 5 along the first section 18 of the cinching path 11. Further, the second cinching mechanism 19 may include a second engagement lever 31 for the engagement with the catch 5, in order to drive the catch 5 along second section 20 of the cinching path 11. The first engagement lever 30 may be out of engagement from the catch 5 along at least a part of the second section 20 of the cinching path 11. In addition or as an alternative, the second engagement lever 31 may be out of engagement from the catch 5 along at least a part of the first section 18 of the cinching path 11.

The first cinching mechanism 17 provides a coupling mechanism 32, which, during the coupling sequence, when reaching the end of the first section 18 of the cinching path 11, enters into a decoupled state and disconnects the drivetrain of this first cinching mechanism 17 to the catch 5. In detail, the coupling mechanism 32 may include a first coupling lever 33 with a first coupling surface 34 and a second coupling lever 35 with a second coupling surface 36. The second coupling lever 35 is driven by the first coupling lever 33 via the engagement of the coupling surfaces 34, 36 for driving the catch 5 along the first section 18 of the cinching path 11. This corresponds to the situation in FIG. 2.

When reaching the end of the first section 18 of the coupling path 11, the coupling levers 33, 35 come out of engagement from each other due to an eccentric arrangement of the coupling levers 33, 35. This is shown in FIG. 3. In this situation, the coupling surfaces 34, 36 slide by each other, as the pivot axis 33*a* of the first coupling lever 33 is spaced from the pivot axis 35*a* of the second coupling lever 35, which corresponds to the above noted, eccentric arrangement.

Here the first coupling lever 33 may be provided by the cinching lever 24, while the second coupling lever 35 may be provided by the first engagement lever 30.

The second cinching mechanism 19 provides a knee lever mechanism 37 with a first knee lever 38 and a second knee lever 39, that are pivotably coupled to each other via a knee joint 40. It may be taken from FIGS. 2 to 4, that the first knee lever 38 is provided by the cinching lever 24, which leads to a particularly compact design. Generally, the first knee lever 38 may be coupled to the cinching lever 24, for example, via an intermediate lever.

The second knee lever 39, here and preferably, is provided by the second engagement lever 31. Again, it may be preferred, that the second knee lever 39 is coupled to the second engagement lever 31, for example via an intermediate lever.

It may be pointed out that the first engagement lever 30 may include an engagement surface 41, which engages a follower surface 42 at the catch 5 along the first section 18 of the cinching path 11. Accordingly, the second engagement lever 31 may include an engagement surface 43, which engages the follower surface 42 along the second section 20 of the cinching path 11.

Accordingly, along the first section 18 of the cinching path 11, the cinching lever 24 drives the first engagement lever 30 via the coupling mechanism 32, leading to the engagement surface 41 of the first engagement lever 30 engaging the follower surface 42 of the catch 5. Subsequently, along the second section 20 of the cinching path 11, the second knee lever 39, which is provided by the second engagement lever 31, moves in a free run movement with respect to the catch 5 and subsequently enters into engagement with the catch 5 for driving the catch 5 along the second section 20 of the cinching path 11. In detail, the engagement surface 43 of the second engagement lever 31 comes into engagement with the follower surface 42 of the catch 5, driving the catch 5 along the second section 20 of the cinching path 11. This corresponds to the sequence of FIG. 3 and FIG. 4. Here it is shown, that along the second section 20 of the cinching path 11, the knee lever mechanism 37 moves from a bent configuration into a stretched configuration, increasing the gear ratio of the knee lever mechanism 37.

In general, the gear ratio of the cinching arrangement 10 is defined by the relation between the torque applied at the catch 5 and the respective driving torque applied at the cinching lever 24 from the motorized cinching drive 25. The drawings show that the gear ratio of the second cinching mechanism 19 is higher than the gear ratio of the first cinching mechanism 19 mechanism 17, especially comparing the situation in FIG. 2, showing the first cinching mechanism 17 with low gear ratio, to the situation in FIG. 4, which shows the second cinching mechanism 19 with high gear ratio. That is especially appropriate, as in the beginning of the cinching sequence, the seals of the closure element 2 provide only low forces, which strongly increase in the course of the cinching sequence.

According to another teaching, the motor vehicle lock arrangement 44 as such is claimed, comprising an above noted motor vehicle lock 1 and a motorized cinching drive 25, which is coupled to the motor vehicle lock 1, via a Bowden cable 26, in order to provide a motorized cinching sequence. All explanations given regarding the embodiment shown in the drawings are fully applicable to this second teaching.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A motor vehicle lock comprising:

a catch configured to pivot along a cinching path, including a first section and a second section, between an open position, a primary closed position, and a secondary closed position, wherein the secondary closed position is disposed between the open position and the primary closed position;

a pawl arrangement moveable between a released state and an engaged state, wherein when the pawl arrangement is in the engaged state, a pawl engages and blocks the catch when the catch is in primary closed position and/or the secondary closed position, wherein when the pawl arrangement is in the released state the pawl does not block the catch; and a cinching arrangement including a first cinching mechanism and a second cinching mechanism, wherein during a cinching sequence, the first cinching mechanism engages and drives the catch along a first section of the cinching path and the second cinching mechanism engages and drives the catch along a second section of the cinching path; wherein the first cinching mechanism includes a first engagement lever configured to engage and pivot the catch along the first section, and wherein the second cinching mechanism includes a second engagement lever configured to engage and pivot the catch along the second section, wherein as the catch pivots along at least a part of the second section, the first engagement lever disengages the catch.

2. The motor vehicle lock of claim 1, wherein the cinching path originates at the secondary closed position of the catch or the open position or a position therebetween.

3. The motor vehicle lock of claim 1, wherein the second section of the cinching path extends from the secondary closed position to the primary closed position or an overtravel position, wherein the overtravel position is disposed beyond the primary closed position.

4. The motor vehicle lock of claim 3, wherein the first section and the second section are partially overlap each other.

5. The motor vehicle lock of claim 1, wherein the cinching arrangement includes a cinching lever moveable from a base position to a cinching position, so that the catch, via the first cinching mechanism, pivots along the first section, and via the second cinching mechanism, the catch pivots along the second section.

6. The motor vehicle lock of claim 1, wherein the first cinching mechanism includes a coupling mechanism, wherein during a coupling sequence, when the catch reaches an end of the first section, the coupling mechanism enters into a decoupled state and disconnects from a drive train of the first cinching mechanism.

7. The motor vehicle lock of claim 6, wherein the coupling mechanism includes a first coupling lever provided with a first coupling surface and a second coupling lever provided with a second coupling surface, wherein the first engagement lever and the second engagement lever are eccentrically arranged so that as the first coupling surface engages the second coupling surface, the second coupling lever is driven by the first coupling lever to drive the catch along the first section of the cinching path, and wherein as the catch reaches the end of the first section, the first coupling lever and the second coupling lever disengage from each other.

8. The motor vehicle lock of claim 7, wherein the cinching lever forms the first coupling lever and wherein the first engagement lever forms the second coupling lever.

9. The motor vehicle lock according of claim 8, wherein the second cinching mechanism forms a knee lever mechanism provided with a first knee lever and a second knee lever, wherein the first knee lever and the second knee lever are pivotably coupled to each other at a knee joint.

10. The motor vehicle lock of claim 9, wherein the first knee lever is either coupled to the cinching lever or is formed by the cinching lever.

11. The motor vehicle lock of claim 10, wherein the second knee lever is either coupled to the second engagement lever or is formed by the second engagement lever.

12. The motor vehicle lock according of claim 11, wherein during the cinching sequence as the catch moves along the second section, the second knee lever moves in a free run movement with respect to the catch so that the second knee lever engages and drives the catch along the second section.

13. The motor vehicle lock of claim 1, wherein a gear ratio is defined by a relation between a torque applied at the catch and a driving torque applied at the cinching lever, and wherein the gear ratio of the second cinching mechanism is greater than the gear ratio of the first cinching mechanism.

14. The motor vehicle lock of claim 1, further comprising a motorized cinching drive coupled to the motor vehicle lock and configured to provide a motorized cinching sequence.

15. The motor vehicle lock of claim 1, wherein as the catch pivots along at least a part of the first section, the second engagement lever is disengaged from the catch.

16. A motor vehicle lock comprising:

a catch configured to pivot along a cinching path, including a first section and a second section, between an open position, a primary closed position, and a secondary closed position, wherein the secondary closed position is disposed between the open position and the primary closed position;

a pawl moveable between a released state, disengaged from the catch, and an engaged state, engaged with the catch, wherein when the catch is in either the primary closed position or the secondary closed position, the pawl is in the engaged state;

a first cinching mechanism including a first engagement lever configured to engage and pivot the catch along the first section;

a second cinching mechanism including a second engagement lever configured to engage and pivot the catch along at least a portion of the second section; wherein the first cinching mechanism includes a first coupling lever provided with a first coupling surface and a second coupling lever provided with a second coupling surface, wherein when the catch reaches an end of the first section, the first coupling lever and the second coupling lever disengage from each other.

17. A motor vehicle lock comprising:

a catch configured to pivot along a cinching path, including a first section and a second section, between an open position, a primary closed position, and a secondary closed position, wherein the secondary closed position is disposed between the open position and the primary closed position;

a pawl moveable between a released state, disengaged from the catch, and an engaged state, engaged with the catch, wherein when the catch is in either the primary closed position or the secondary closed position, the pawl is in the engaged state;

a cinching lever configured to pivot about a cinching-lever axis along a cinching lever path including a third section and a fourth section;

a first engagement lever including a first end, wherein when the first engagement lever is in a first position, the first end of the first engagement lever biases the catch to the open position;

a second engagement lever pivotally coupled to the cinching lever;

a coupling lever configured to pivot about a coupling-lever axis, wherein as the cinching lever pivots along the third section, the coupling lever pivots the first engagement lever from the first to a second position so that the first engagement lever engages and drives the catch and pivots the catch along the first section from the open position to the secondary closed position, and wherein as the cinching lever pivots along the fourth section, the first engagement lever disengages from the catch and the second engagement lever drives the catch along the second section from the secondary closed position to the primary closed position.

18. The motor vehicle lock of claim 17, further comprising a motor and a cable, wherein the cable engages the cinching lever and wherein actuation of the motor moves the cinching lever along the cinching lever path.

* * * * *